US010064507B1

(12) United States Patent
Shih

(10) Patent No.: US 10,064,507 B1
(45) Date of Patent: Sep. 4, 2018

(54) SPILL PROOF DISPOSABLE CUP

(71) Applicant: Andrew T. Shih, Palo Alto, CA (US)

(72) Inventor: Andrew T. Shih, Palo Alto, CA (US)

( * ) Notice: Subject to any disclaimer, the term of this patent is extended or adjusted under 35 U.S.C. 154(b) by 21 days.

(21) Appl. No.: 15/719,655

(22) Filed: Sep. 29, 2017

Related U.S. Application Data

(63) Continuation of application No. 15/663,818, filed on Jul. 31, 2017.

(51) Int. Cl.

| | |
|---|---|
| ***B65D 45/32*** | (2006.01) |
| ***A47G 19/22*** | (2006.01) |
| ***B65D 43/02*** | (2006.01) |
| ***B65D 51/18*** | (2006.01) |
| ***B65D 47/12*** | (2006.01) |
| ***B65D 53/02*** | (2006.01) |

(52) U.S. Cl.
CPC ..... *A47G 19/2272* (2013.01); *B65D 43/0212* (2013.01); *B65D 47/12* (2013.01); *B65D 51/18* (2013.01); *B65D 53/02* (2013.01); *B65D 2251/009* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01); *B65D 2543/00537* (2013.01); *B65D 2543/00648* (2013.01); *B65D 2543/00694* (2013.01); *B65D 2543/00731* (2013.01); *B65D 2543/00805* (2013.01)

(58) Field of Classification Search
CPC ..... A47G 19/2272; B65D 47/12; B65D 43/0212; B65D 53/02; B65D 51/18; B65D 2543/00731; B65D 2543/00537; B65D 2251/0081; B65D 2251/0025; B65D 2543/00046; B65D 2543/00648; B65D 2543/00805; B65D 2543/00694; B65D 2251/0087; B65D 2251/009
USPC ..... 220/315–322, 233
See application file for complete search history.

(56) References Cited

U.S. PATENT DOCUMENTS

| | | | | |
|---|---|---|---|---|
| 8,561,830 | B2 * | 10/2013 | Hallberg | A47G 19/2227 220/592.17 |
| 2010/0187247 | A1 * | 7/2010 | Ziegler | A47G 23/0233 220/783 |
| 2014/0117016 | A1 * | 5/2014 | Hodge | B65D 43/0212 220/254.9 |

* cited by examiner

*Primary Examiner* — Kareen Thomas

(57) ABSTRACT

The present disclosure describes a security ring mated to a cup lid of a disposable cup for a spill-proof purpose. The security ring, when engaged with the paired cup lid, provides a seal for the disposable cup as well as inseparableness from each other in the event the disposable cup is toppled or falls from a high ground. The engagement in the first embodiment of the present disclosure between the security ring and the cup lid arises from a secure reception of one or more interlocking members on the cup lid by one or more corresponding retaining members on the security ring. The engagement in the second embodiment involves a hitching member and a receiving member on the security ring capable of latching up therein at a plurality of locations so as to accommodate the cup lid having a plurality of heights and shapes.

3 Claims, 5 Drawing Sheets

SPILL PROOF DISPOSABLE CUP

BACKGROUND

The cup lids for disposable cups may come in a variety of forms designed to contain the liquid inside the disposable cup without spillover when a minor accident occurs. Some such lids have an annular mounting portion which can be snapped onto the top rims of the disposable cups to provide a seal. The snap-on portions of the cup lid may be detached from the disposable cup when the disposable cup experiences a harsh impact such as falling from a high ground or a person while carrying the disposable cup in motion bumps into a person/object. Therefore, the snap-on cup lids deliver only a limited amount of protection over spillage. Securing the cup lids in place under such circumstance may provide additional protection and/or avoid burn injuries for a mobile individual carrying a hot beverage.

BRIEF DESCRIPTION OF THE DRAWINGS

The detailed description is described with reference to the accompanying figures, in which the left-most digit(s) of a reference number identifies the figure in which the reference number first appears. The use of the same reference numbers in different figures indicates similar or identical items.

The figures are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION

The present disclosure relates to a security ring fitted to a generally circular disposable cup, wherein the security ring secures the cup lid on the disposable cup with an exerted tension, providing a stronghold of drop-resistant seal.

Figure 1:
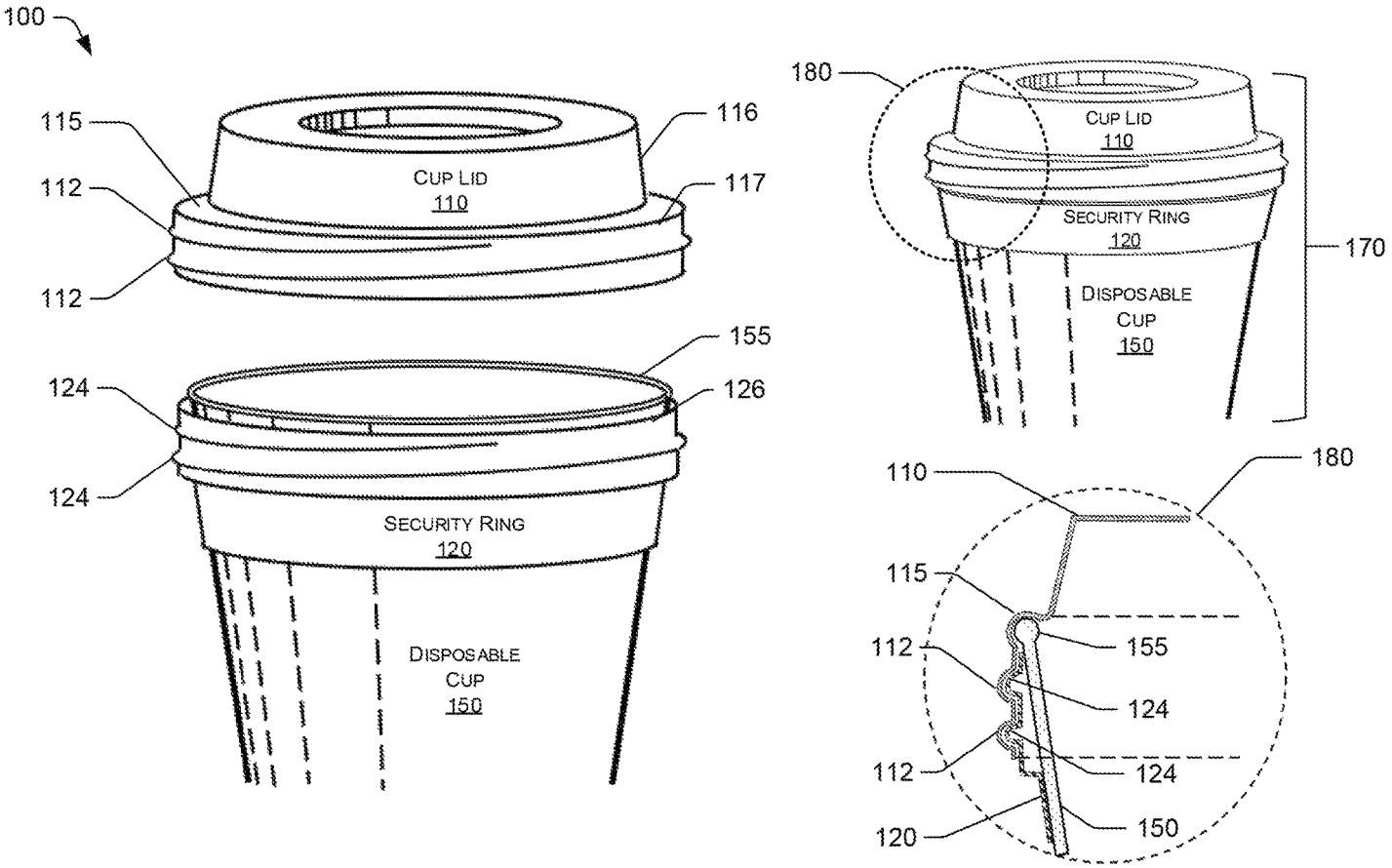
FIG. 1 illustrates a cup lid with integrally formed threads and a security ring with matching opposite threads. The disposable cup is sealed when the cup lid is screwed onto the security ring.

FIG. 1 illustrates a cup assembly 100 of a security ring 120 and a cup lid 110 on a disposable cup 150 in accordance with an embodiment of the present disclosure. Security ring 120 may be made with the same material as cup lid 110 and may be inserted from the bottom of disposable cup 150 to fit snugly onto the disposable cup 150, preferable at the upper part of the cup wall of disposable cup 150. Security ring 120 may comprise a substantially vertical wall 126 which may have an inside diameter no larger than an outside diameter of a stop member 155 of disposable cup 150 to prevent slipping out of disposable cup 150. Stop member 155 may be the top rim of a cone-shaped disposable cup 150 as exemplified in FIG. 1.

Cup lid 110 may contain a seal portion 115 of an annular ring shape depending from a top wall 116, wherein seal portion 115 may form a seal with disposable cup 150 when an impressed contact is established between seal portion 115 and the top rim surface of stop member 155. Seal portion 115 may be flexible and capable of conforming onto the curvature of the top surface of stop member 155. Cup lid 110 may also comprise a substantially vertical wall 117 extended below seal portion 115 where an interlocking helical shaped thread 112 is embossed on extended vertical wall 117.

Security ring 120 may comprise a retaining thread 124 embossed on its vertical wall 126. Retaining thread 124 on security ring 120 needs to have a matching and opposite thread with respect to interlocking thread 112 on cup lid 110 so that they can be screwed together by rotating cup lid 110 to progressively follow the threads. Interlocking thread 112 and retaining thread 124 may be formed integrally with cup lid 110 and security ring 120 respectively.

Numeral reference 170 displays a sealed disposable cup 150 when cup lid 110 is screwed onto security ring 120 to achieve an engagement between cup lid 110 and security ring 120. Dotted circle 180 projects an enlarged view detailing how interlocking member(s) of cup lid 110 is(are) engaged with retaining member(s) of security ring 120. The engagement may refer to forming an impressed contact between seal portion 115 and top rim surface of stop member 155. As shown inside dotted circle 180, interlocking thread 112 is corded onto retaining thread 124 to establish the engagement and the seal thereof.

In another embodiment of the present disclosure, retaining thread 124 on security ring 120 may be integrally formed with disposable cup 150 in a one-piece configuration. Thus, disposable cup 150 may comprise a substantially vertical top wall embossed with retaining thread 124 for facilitating the engagement with cup lid 110.

In another embodiment of the present disclosure, seal portion 115 of cup lid 110 may be capable of being snapped onto the top rim of stop member 155 to further improve the seal of disposable cup 150.

Figure 2:
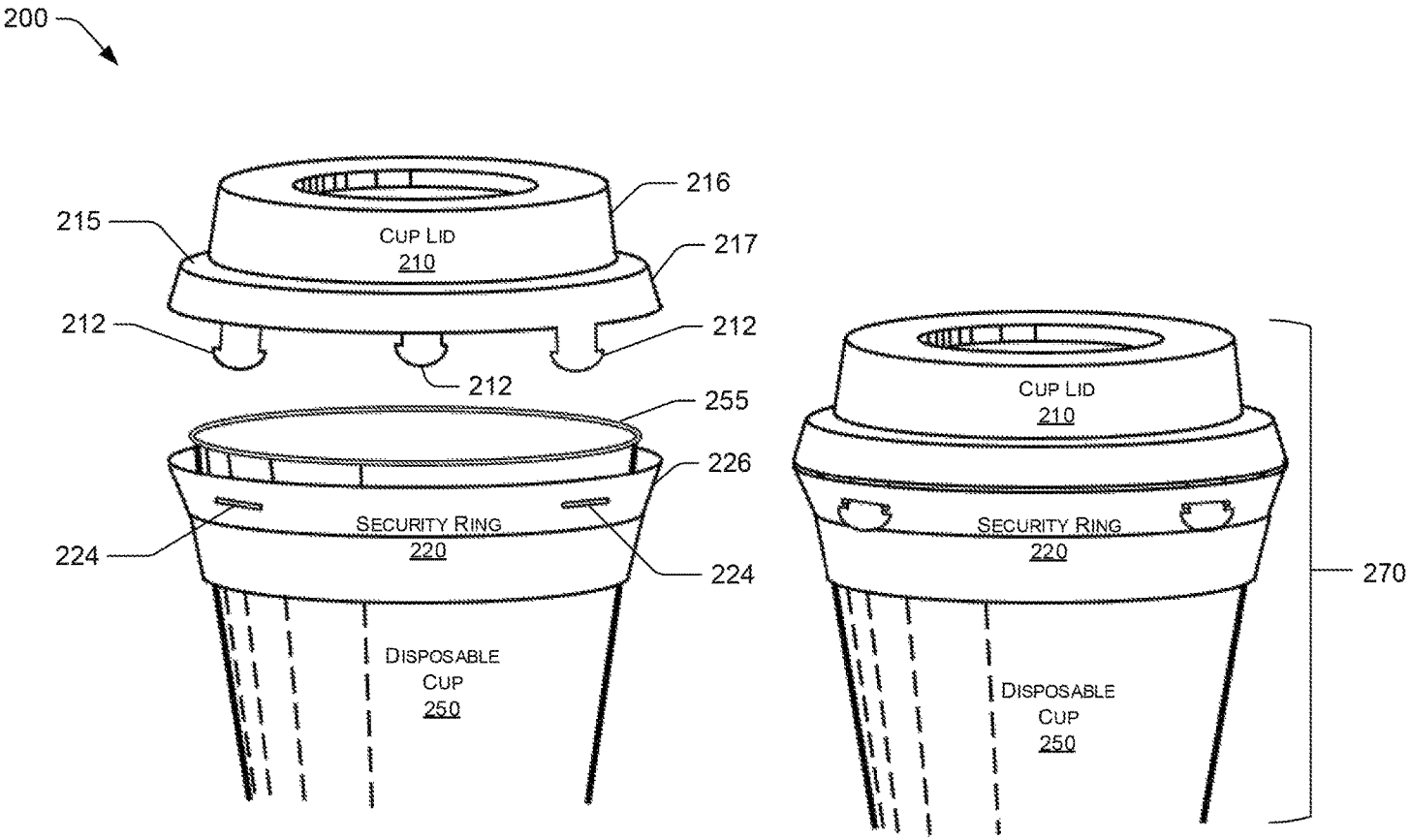
FIG. 2 illustrates a cup lid with a plurality of anchor-type interlocking members and a security ring with a plurality of slit-type retaining members. The disposable cup is sealed when the interlocking anchors are latched with the retaining slits.

FIG. 2 illustrates a cup assembly 200 of a security ring 220 and a cup lid 210 on a disposable cup 250 in accordance with another embodiment of the present disclosure. Security ring 220 may comprise a sloped wall 226 and may be inserted from the bottom of disposable cup 250 to fit snugly onto the disposable cup 250, preferable at the upper part of the cup wall of disposable cup 250. Security ring 220 may have an inside diameter no larger than an outside diameter of a stop member 255 of disposable cup 250 to prevent slipping out of disposable cup 250. Stop member 255 may be the top rim of a cone-shaped disposable cup 250 as exemplified in FIG. 2.

Cup lid 210 may contain a seal portion 215 of an annular ring shape depending from a top wall 216, wherein seal portion 215 may form a seal with disposable cup 250 when an impressed contact is established between seal portion 215 and the top rim surface of stop member 255. Seal portion 215 may be flexible and capable of conforming onto the curvature of the top surface of stop member 255. Cup lid 210 may comprise one or more integrally formed anchor-shaped inserts 212 for interlocking with security ring 220.

Security ring 220 may comprise one or more slits 224 on sloped wall 226 to accept and engage with corresponding anchor-shaped inserts 212. The one or more slits 224 are dimensioned to hold the head part of anchor-shaped inserts 212 in preventing which being pulled out unexpectedly. When all anchor-shaped inserts 212 are pushed through the corresponding slits 224, cup lid 210 are interlocked with security ring 220 in such a way that a light tension exists between cup lid 210 and security ring 220.

Numeral reference 270 displays a sealed disposable cup 250 when cup lid 210 is interlocked with security ring 220 to achieve a seal between cup lid 210 and disposable cup 250. The seal may be formed by the light tension exerting a down force on seal portion 215 to conform to the top surface of stop member 255.

Figure 3:
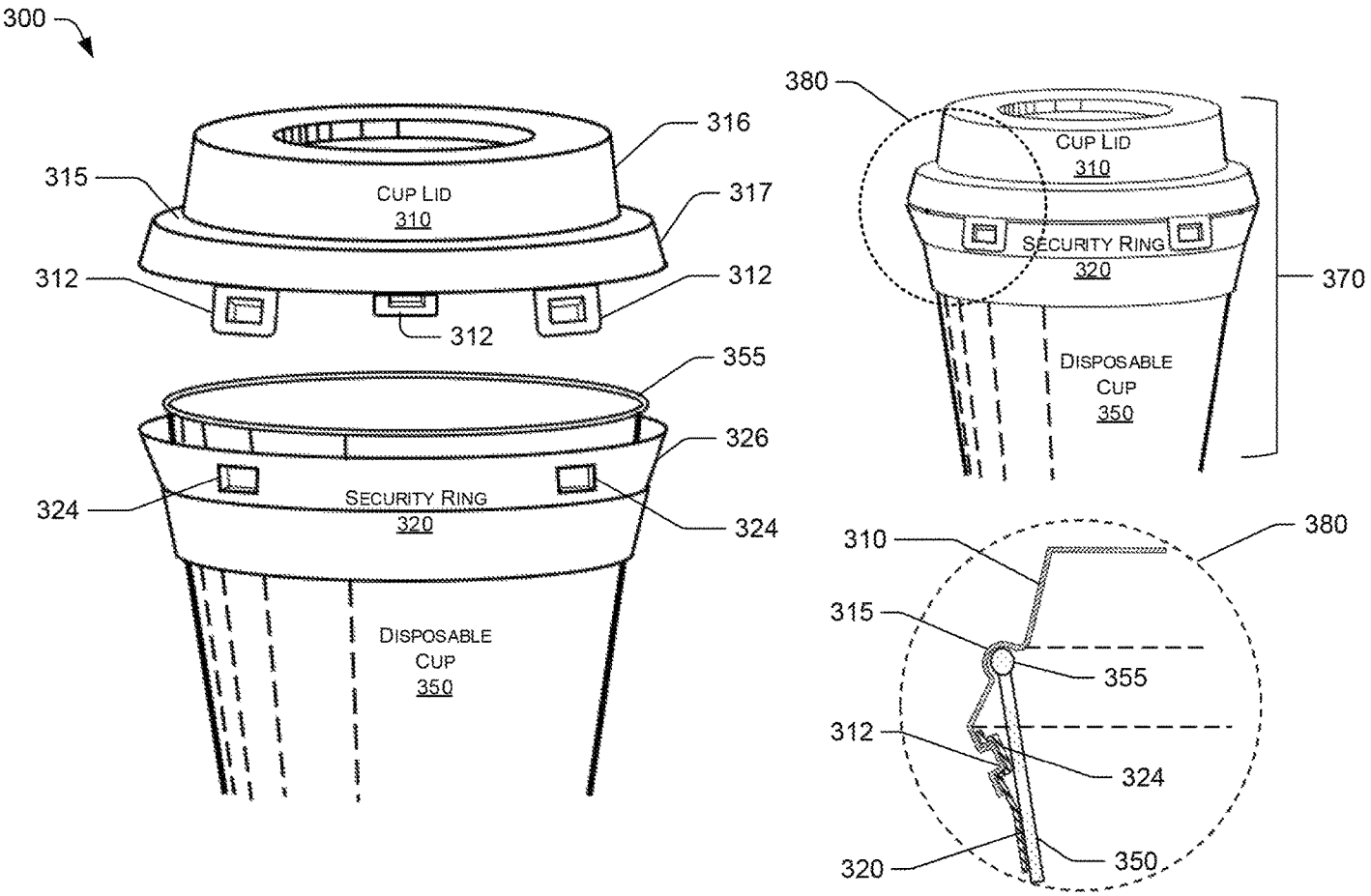
FIG. 3 illustrates a cup lid with a plurality of plug-type interlocking members and a security ring with a plurality of recess-type retaining members. The disposable cup is sealed when the interlocking plugs are inserted into the retaining recess holes.

FIG. 3 illustrates a cup assembly 300 of a security ring 320 and a cup lid 310 on a disposable cup 350 in accordance with another embodiment of the present disclosure. Security ring 320 may comprise a sloped wall 326 and may be inserted from the bottom of disposable cup 350 to fit snugly onto the disposable cup 350, preferable at the upper part of the cup wall of disposable cup 350. Security ring 320 may have an inside diameter no larger than an outside diameter of a stop member 355 of disposable cup 350 to prevent slipping out of disposable cup 350. Stop member 355 may be the top rim of a cone-shaped disposable cup 350 as exemplified in FIG. 3.

Cup lid 310 may contain a seal portion 315 of an annular ring shape depending from a top wall 316, wherein seal portion 315 may form a seal with disposable cup 350 when an impressed contact is established between seal portion 315 and the top rim surface of stop member 355. Seal portion 315 may be flexible and capable of conforming onto the curvature of the top surface of stop member 355. Cup lid 310 may comprise one or more integrally formed buckle buttons 312 for interlocking security ring 320.

Security ring 320 may comprise one or more recess holes 324 on sloped wall 326 to accept and engage with corresponding buckle buttons 312. The one or more recess holes 324 are dimensioned to hold buckle buttons 312 in place while preventing buckle buttons 312 being pulled out unexpectedly. When all buckle buttons 312 are plugged into the corresponding recess holes 324, cup lid 310 are interlocked with security ring 320 in such a way that a light tension exists between cup lid 310 and security ring 320.

Numeral reference 370 displays a sealed disposable cup 350 when cup lid 310 is interlocked with security ring 320 to achieve a seal between cup lid 310 and disposable cup 350. The seal may be formed by the light tension exerting a down force on seal portion 315 to conform to the top surface of stop member 355. Dotted circle 380 projects an enlarged view detailing how buckle buttons 312 of cup lid 310 are engaged with recess holes 324 of security ring 320. The engagement may refer to forming an impressed contact between seal portion 315 and top rim surface of stop member 355. As shown inside dotted circle 380, buckle buttons 312 are stuck into recess holes 324 to establish the engagement and the seal thereof.

In other embodiments of the present disclosure, the shapes of buckle buttons 312 may include square, round, or polygonal shapes. Recess holes 324 may have corresponding shapes as buckle buttons 312 and may further comprise a pinched region having a smaller inside diameter to enhance retention of buckle buttons 312.

Figure 4:
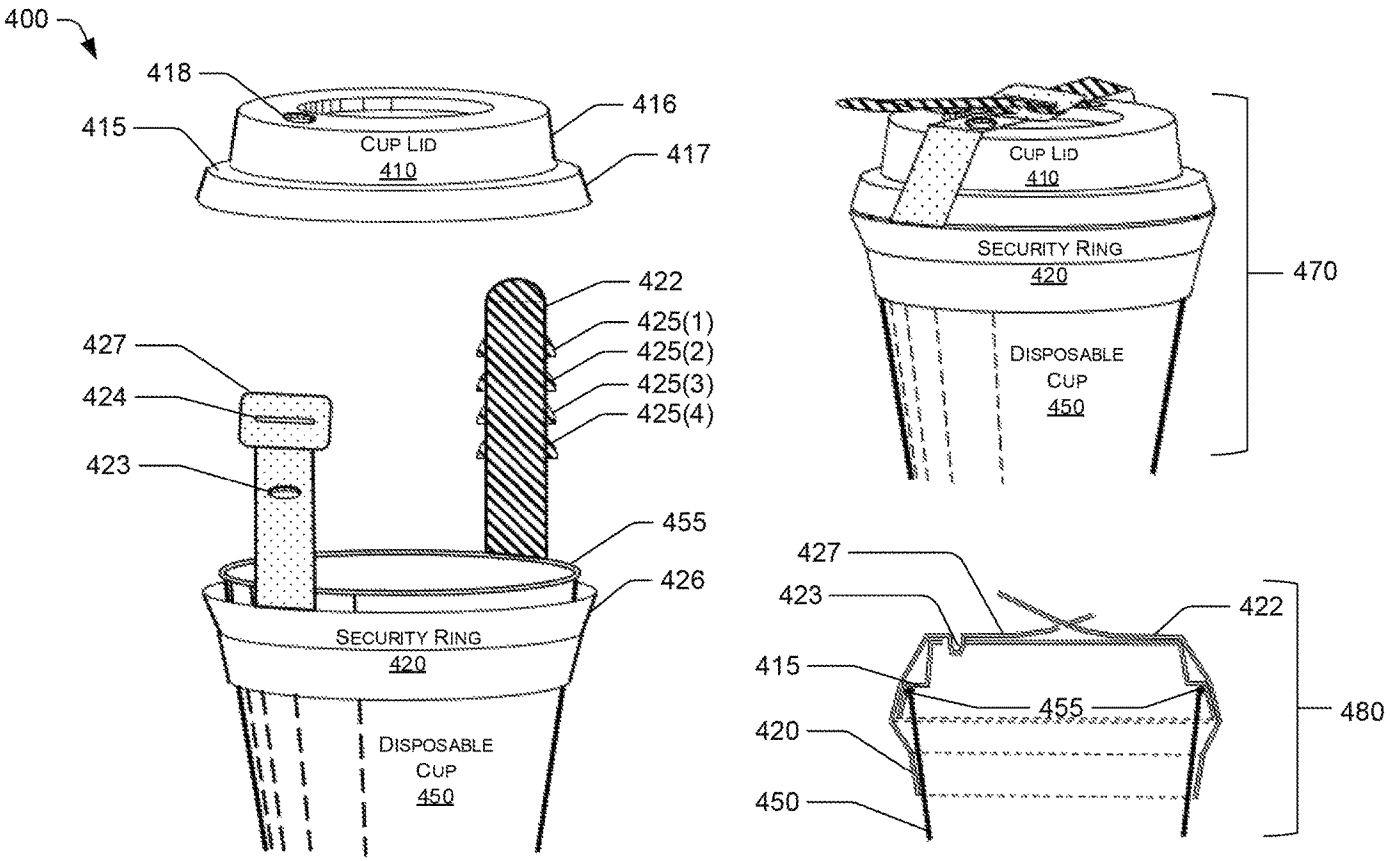
FIG. 4 illustrates a hitching member and a receiving member on a security ring capable of holding the cup lid inseparable from the disposable cup, wherein the disposable cup is sealed when the hitching teeth are latched with the receiving slit(s).

FIG. 4 illustrates a cup assembly 400 of a security ring 420 and a cup lid 410 on a disposable cup 450 in accordance with another embodiment of the present disclosure. Security ring 420 may comprise a sloped wall 426 and may be inserted from the bottom of disposable cup 450 to fit snugly onto the disposable cup 450, preferable at the upper part of the cup wall of disposable cup 450. Security ring 420 may have an inside diameter no larger than an outside diameter of a stop member 455 of disposable cup 450 to prevent slipping out of disposable cup 450. Stop member 455 may be the top rim of a cone-shaped disposable cup 450 as exemplified in FIG. 4.

Cup lid 410 may contain a seal portion 415 of an annular ring shape depending from a top wall 416, wherein seal portion 415 may form a seal with disposable cup 450 when an impressed contact is established between seal portion 415 and the top rim surface of stop member 455. Seal portion 415 may be flexible and capable of conforming onto the curvature of the top surface of stop member 455. Cup lid 410 may also contain a drink hole 418 for allowing beverage inside disposable cup 450 to be sipped.

Security ring 420 may comprise a hitching band 422 and a receiving band 427 with a receiving slit 424. A plurality of teeth pairs 425(1)-425(4) may be located on hitching band 422 and separated by a predetermined spacing. The spacing and number of teeth pairs in FIG. 4 are for illustrative purpose only and may be increased/decreased for being able to adjust the position of engagement with receiving slit 424. One of teeth pairs 425(1)-425(4) is engaged with receiving slit 424 to fasten cup lid 410 tightly over disposable cup 450. Receiving slit 424 is dimensioned to retain hitching band 422 in place while preventing one or more teeth pairs 425(1)-425(4) from being pulled out unexpectedly. One can feed hitching band 422 through receiving slit 424 and select one of teeth pairs 425(1)-425(4) as the last withhold according to the height and shape of cup lid 410 to achieve a proper tie-down. A light tension exists between cup lid 410 and security ring 420 when a proper tie-down is achieved. A button plug 423 may be provided on receiving band 427 and dimensioned to seal drink hole 418 when it is inserted into drink hole 418.

Numeral reference 470 displays a sealed disposable cup 450 when cup lid 410 is strapped down via the engagement of hitching band 422 and receiving slit 424 to achieve a seal between cup lid 410 and disposable cup 450. The seal between cup lid 410 and disposable cup 450 may be formed by the light tension exerting a down force on seal portion 415 to conform to the top surface of stop member 455. Numeral reference 480 displays a cross section detailing how cup lid 410 is fastened by hitching band 422 and receiving band 427 when one of teeth pairs 425(1)-425(4) is withheld by receiving slit 424, and button plug 423 is inserted to seal drink hole 418.

Figure 5:
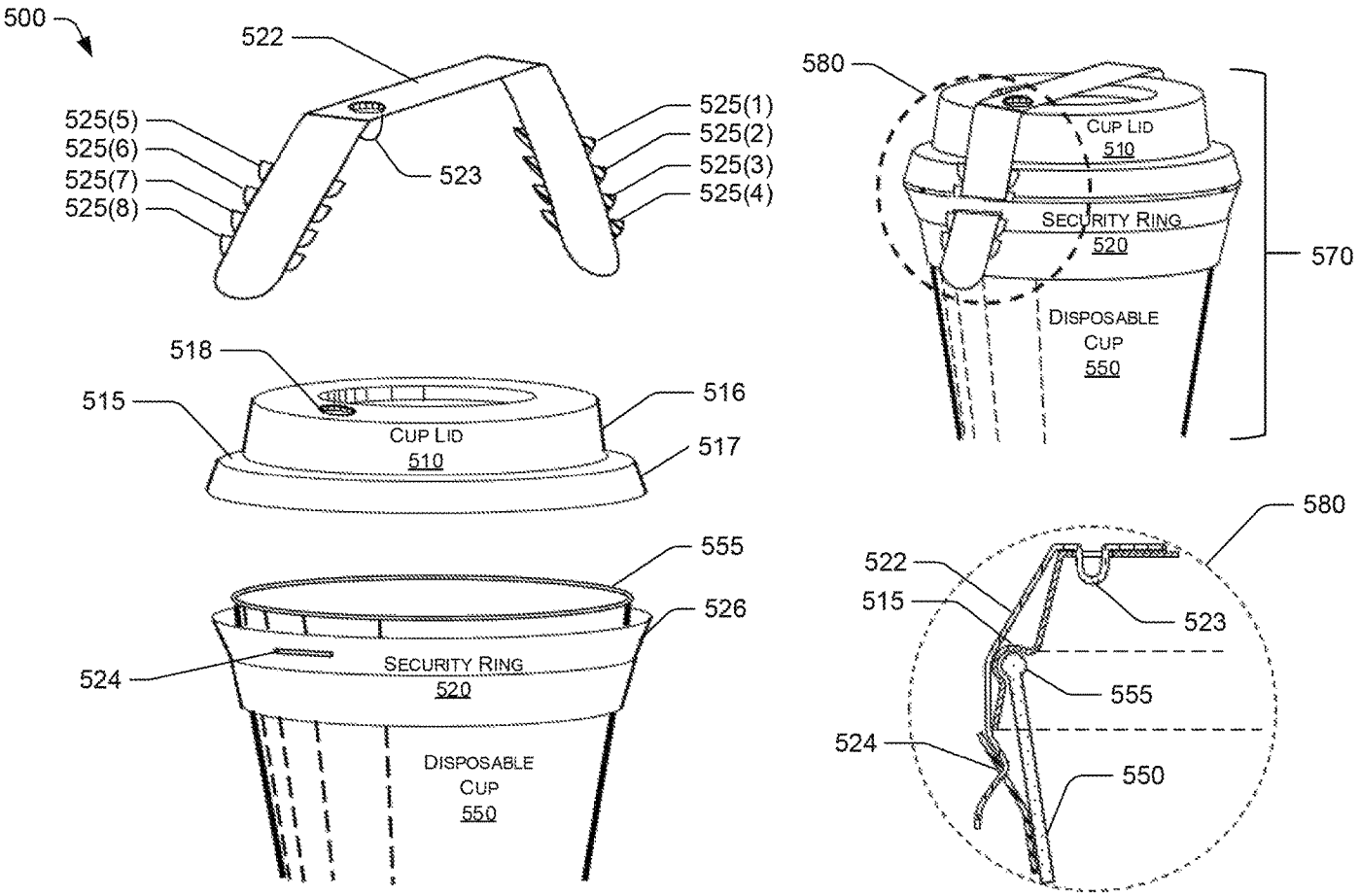
FIG. 5 illustrates a detachable hitching member and corresponding receiving members on a security ring capable of holding the cup lid inseparable from the disposable cup, wherein the disposable cup is sealed when the hitching teeth are latched with the receiving slits.

FIG. 5 illustrates a cup assembly 500 of a security ring 520 and a cup lid 510 on a disposable cup 550 in accordance with another embodiment of the present disclosure. Security ring 520 may comprise a sloped wall 526 and may be inserted from the bottom of disposable cup 550 to fit snugly onto the disposable cup 550, preferable at the upper part of the cup wall of disposable cup 550. Security ring 520 may have an inside diameter no larger than an outside diameter of a stop member 555 of disposable cup 550 to prevent slipping out of disposable cup 550. Stop member 555 may be the top rim of a cone-shaped disposable cup 550 as exemplified in FIG. 5.

Cup lid 510 may contain a seal portion 515 of an annular ring shape depending from a top wall 516, wherein seal portion 515 may form a seal with disposable cup 550 when an impressed contact is established between seal portion 515 and the top rim surface of stop member 555. Seal portion 515 may be flexible and capable of conforming onto the curvature of the top surface of stop member 555. Cup lid 510 may also contain a drink hole 518 for allowing beverage inside disposable cup 550 to be sipped.

Security ring 520 may comprise a detachable hitching band 522 and two receiving slits 524 on sloped wall 526. A plurality of teeth pairs 525(1)-525(8) may be located on hitching band 522 and separated by a predetermined spacing. The spacing and number of teeth pairs in FIG. 5 are for illustrative purpose only and may be increased/decreased for being able to adjust the position of engagement with receiving slits 524. One of teeth pairs 525(1)-525(4) and another of teeth pairs 525(5)-525(8) are engaged with respective receiving slits 524 to fasten cup lid 510 tightly over disposable cup 550. Receiving slits 524 are dimensioned to retain hitching band 522 in place while preventing one or more teeth pairs 525(1)-525(8) from being pulled out unexpectedly. One can feed hitching band 522 through both receiving slits 524 and select one of teeth pairs 525(1)-525(4) and another of teeth pairs 525(5)-525(8) as the last withholds according to the height and shape of cup lid 510 to achieve a proper tie-down. A light tension exists between cup lid 510 and security ring 520 when a proper tie-down is achieved. A button plug 523 may be provided on hitching band 522 and dimensioned to seal drink hole 518 when it is inserted into drink hole 518.

Numeral reference 570 displays a sealed disposable cup 550 when cup lid 510 is strapped down via the engagement of hitching band 522 and receiving slits 524 to achieve a seal between cup lid 510 and disposable cup 550. The seal between cup lid 510 and disposable cup 550 may be formed by the light tension exerting a down force on seal portion 515 to conform to the top surface of stop member 555. Dotted circle 580 projects an enlarged view detailing how cup lid 510 is fastened by hitching band 522 via withholding one of teeth pairs 525(1)-525(4) on receiving slits 524, and button plug 523 is inserted to seal drink hole 518.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

The descriptions of the various embodiments of the present teachings have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While the foregoing has described what are considered to be the best state and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

The components, steps, features, objects, benefits and advantages that have been discussed herein are merely illustrative. None of them, nor the discussions relating to them, are intended to limit the scope of protection. While various advantages have been discussed herein, it will be understood that not all embodiments necessarily include all advantages. Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

Numerous other embodiments are also contemplated. These include embodiments that have fewer, additional, and/or different components, steps, features, objects, benefits and advantages. These also include embodiments in which the components and/or steps are arranged and/or ordered differently.

What is claimed is:

1. A disposable cup, comprising:

a cup lid having a seal portion for sealing the cup;

one or more interlocking members on the cup lid, wherein the one or more interlocking members are configured as a plurality of forms of male-type connecting devices, and wherein the plurality of forms of the male-type connecting devices include anchors, inserts and plugs;

a security ring with one or more corresponding retaining members, wherein the one or more corresponding retaining members are configured as a plurality of forms of female-type connecting devices, and wherein the plurality of forms of the female-type connecting devices include slits and pinched openings dimensioned and configured to lock up the respective male-type connecting devices in a plurality of positions; and an engagement between the one or more interlocking members of the cup lid and the one or more corresponding retaining members of the security ring at the plurality of positions in such a way that the cup lid remains inseparable from the disposable cup in response to toppling events of the disposable cup.

2. A disposable cup, comprising:

a cup lid having a seal portion for sealing the cup, wherein the cup lid contains a drink hole;

a security ring having a hitching member and a receiving member configured to fasten the cup lid to the disposable cup, wherein the hitching member contains a plug member dimensioned to seal the drink hole when the plug member is inserted into the drink hole; and an engagement between the hitching member and the receiving member in such a way that the cup lid remains inseparable from the disposable cup in response to toppling events of the disposable cup.

3. The disposable cup of claim 2, wherein the hitching member comprises a plurality forms including belts and straps, and wherein the receiving member comprises a plurality of forms including buckles and clasps which are dimensioned and configured to fasten the cup lid to the disposable cup when the engagement is carried out.

* * * * *